United States Patent [19]

Ong et al.

[11] Patent Number: 4,946,754

[45] Date of Patent: Aug. 7, 1990

[54] PHOTOCONDUCTIVE IMAGING MEMBERS WITH DIARYL BIARYLYLAMINE CHARGE TRANSPORTING COMPONENTS

[75] Inventors: Beng S. Ong, Mississauga; Barkev Keoshkerian, Thornhill; Giuseppa Baranyi, Mississauga, all of Canada

[73] Assignee: Xerox Corporation, Stamford, Conn.

[21] Appl. No.: 274,160

[22] Filed: Nov. 21, 1988

[51] Int. Cl.[5] ..... G03G 5/14

[52] U.S. Cl. ..... 430/59

[58] Field of Search ..... 430/59

[56] References Cited

U.S. PATENT DOCUMENTS

| | | | |
|---|---|---|---|
| 3,180,730 | 4/1965 | Klupfel et al. . | |
| 3,265,496 | 8/1966 | Fox . | |
| 4,233,384 | 11/1980 | Turner et al. | 430/59 |
| 4,273,846 | 6/1981 | Pai et al. | 430/59 |
| 4,450,218 | 5/1984 | Takei et al. | 430/59 |
| 4,471,039 | 9/1984 | Borsenburger et al. | 430/58 |
| 4,582,772 | 4/1986 | Teuscher et al. | 430/58 |
| 4,637,971 | 1/1987 | Takei et al. | 430/59 |
| 4,664,995 | 5/1987 | Horgan et al. | 430/59 |
| 4,719,163 | 1/1988 | Staudenmayer et al. | 430/58 |
| 4,725,518 | 2/1988 | Carmichael et al. | 430/58 |
| 4,769,302 | 9/1988 | Ueda | 430/59 |

FOREIGN PATENT DOCUMENTS

| | | | |
|---|---|---|---|
| 58-1155 | 1/1983 | Japan | 430/59 |
| 61-132953 | 1/1983 | Japan . | |
| 58002849 | 6/1986 | Japan . | |

*Primary Examiner*—Roland E. Martin

*Attorney, Agent, or Firm*—E. O. Palazzo

[57] ABSTRACT

A photoconductive imaging member comprised of a photogenerating layer; and a charge transport layer comprised of diaryl biarylylamine compounds of Formula (I) wherein Ar and Ar′ are independently selected from the group consisting of phenyl, naphthyl, substituted naphthyl, and substituted phenyl; R and R′ are electron donating substituents; and m and n represent the numbers 0, 1 or 2.

2 Claims, 1 Drawing Sheet

PHOTOCONDUCTIVE IMAGING MEMBERS WITH DIARYL BIARYLYLAMINE CHARGE TRANSPORTING COMPONENTS

BACKGROUND OF THE INVENTION

This invention is generally directed to photoconductive imaging members with charge transport compound components. More specifically, the present invention is directed to layered imaging members with charge transport compounds selected in some instances, for example, diaryl biarylylamine derivatives. The aforementioned charge transport compounds, or components possess a number of advantages including excellent charge transporting characteristics; they are environmentally safe and nonhazardous; and these compounds, which possess structral simplicities which simplify their synthesis by known economic processes including the well known Ullman condensation, can be obtained in excellent yields. Also, the charge transport compounds of the present invention exhibit excellent compatibility with known resinous binders, such as polycarbonates, polyesters, and the like, thereby inhibiting or substantially eleiminating the undesirable crystallization thereof in the transport matrices. Additionally, the charge transport compounds illustrated herein enable photoconductive imaging members can be selected for electrophotographic imaging and printing processes for an extended number of imaging cycles exceeding, for example, at least 50,000 cycles. Furthermore, the charge transport molecules or compounds of the present invention possess acceptable solubility in common organic solvents such as halogenated, especially chlorinated hydrocarbons, tetrahydrofuran, toluene, xylene, and the like, thus enabling improved coatability thereof by various processes such as spray, dip and drawdown coating techniques. In one embodiment of the present invention, the imaging member is comprised of a supporting substrate, a photogenerating layer, and in contact therewith a charge transport layer comprised of the diaryl biarylylamines of the formulas illustrated herein. The charge transport layer can be located as the top layer of the imaging member, or alternatively it may be situated between the supporting substrate and the photogenerating layer.

The formation and developement of electrostatic latent images on the imaging surfaces of photoconductive materials by electrostatic means is well known. Numerous different photoconductive members for use in xerography are known such as selenium, alloys of selenium, layered imaging members comprised of aryl amine charge transport layers, reference U.S. Pat. No. 4,265,990, and imaging members with charge transport layers comprised of polysilylenes, reference U.S. Pat. No. 4,618,551. The disclosures of the aforementioned patents are totally incorporated herein by reference. However, the layered imaging members incorporating the diaryl biarylylamine layer of the present invention are, for example, economically more attractive than, for example, the members of the '790 and '551 patent in respect of material and fabrication costs, and possess the other advantages illustrated herein. More specifically, the diaryl biarylylamine derivatives charge transport compounds of the present invention can be synthesized from readily available inexpensive starting materials by cost effective synthetic processes.

There are also known photoreceptor materials comprised of other inorganic or organic materials wherein the charge generation and charge carrier transport functions are accomplished by discrete contiguous layers. Additionally, photoreceptor materials are disclosed in the prior art which include an overcoating layer of an electrically insulating polymeric material, and in conjunction with this overcoated type photoreceptor there have been proposed a number of imaging methods.

Specifically, layered photoresponsive device including those comprised of photogenerating layers and transport layers are disclosed in U.S. Pat. No. 4,265,990, and overcoated photoresponsive materials containing a hole injecting layer overcoated with a transport layer followed by an overcoating of a photogenerating layer and a top coating of an insulating organic resin, reference U.S. Pat. No. 4,251,612. Examples of generating layers disclosed in these patents include trigonal selenium and vanadyl phthalocyanine, while examples of the charge transport layer that may be employed are comprised of the aryl diamines as mentioned therein. The '990 patent is of particular interest in that it discloses layered photoresponsive imaging members similar to those illustrated in the present application with the exception that the charge transporting component of the members of the present invention are comprised of diaryl biarylylamine derivatives of the formulas illustrated herein. These members can be utilized in electrophotographic methods by, for example, initially charging the member with an electrostatic charge and imagewise exposing to form an electrostatic latent image which can be subsequently developed to form a visible image. Other representative patents disclosing layered photoresponsive devices include U.S. Pat. Nos. 4,115,116; 4,047,949 and 4,081,274.

As a result of a patentability search there were located U.S. Pat. Nos. 4,725,518; 4,664,995; 3,265,496; 3,180,730; 4,471,039 and as background interest 4,585,772 and 4,769,302. Disclosed in the '518 patent is an electrophotographic imaging member containing a charge transport layer by forming a mixture comprising a charge transporting aromatic amine compound of one or more compounds having the general formula illustrated in the Abstract, a polymeric film forming resin in which the aromatic amine is soluble, and from about 1 part per million to about 10,000 parts per million of a protonic acid or a lewis acid having a boiling point greater than 40° C., reference the Abstract of the Disclosure, and column 12, beginning at line 17. In the U.S. Pat. No. 3,265,496 , there is mentioned as photoactive compounds a tertiary amine that could be biphenyl diphenyl amine, see column 2, beginning at line 19, and particularly line 27, and column 2, beginning at line 50. In U.S. Pat. No. 3,180,730, there are disclosed triphenyl amines as photoactive compounds, see columns 1 and 2, for example; while U.S. Pat. No. 4,471,039 suggests at column 5 that triphenyl amines can be selected as hole transport compounds for photoconductive materials.

As a result of a patentability search in related U.S. Pat. No. 4,869,988 with the listed inventors Beng Ong and Giuseppa Baranyi, entitled Photoconductive Imaging Members With N,N-bis(biarylyl)aniline, or tris(-biarylyl)amine Charge Transporting Components, the disclosure of which is totally incorporated herein by reference, there were located Japanese Koni abstract J5 8002-849, which discloses photoconductors comprising a laminate of a carrier generation layer A and a charge transport layer B, which layer contains an amine derivative of Formula I, which amine is similar to the charge transport compounds of the present invention, a carbazole derivative of Formula II, and a polymeric organic semiconductor having a condensed aromatic ring or hetero ring in the side chain; Ricoh Japanese abstract 61-132953, which discloses an electrophotographic sensitive body with a trisazo pigment of Formula I and a charge transfer layer of Formula V, which transfer layer is similar to the charge transport compounds of the present invention; and as background or collateral interest U.S. Pat. Nos. 4,233,384; 4,273,846; 4,450,218; 4,637,971 and 4,719,963. In the aforementioned copending application, there is disclosed an improved layered photoconductive imaging member comprised of a supporting substrate, a photogenerating layer optionally dispersed in an inactive resinous binder, and in contact therewith a charge transport layer comprised of bis(-biarylyl)aniline derivatives (I), tris(biarylyl)amine derivatives (II), or mixtures thereof dispersed in resinous binders.

Examples of specific charge transporting components disclosed in the aforementioned copending application include, N,N-bis(4-biphenylyl)-3,5-dimethoxyaniline (Ia); N,N-bis(4-biphenylyl)-3,5-dimethylaniline (Ib); N,N-bis(4-methyl-4'-biphenylyl)-3-methoxyaniline (Ic); N,N-bis(4-methyl-4'-biphenylyl)-3-chloroaniline (Id); N,N-bis(4-methyl-4'-biphenylyl)-4-ethylaniline (Ie; N,N-bis(4-chloro-4'-biphenylyl)-3-methylaniline (If); N,N-bis(4-bromo-4'-biphenylyl)-3,5-dimethoxyaniline (Ig); 4-biphenylyl bis(4-ethoxycarbonyl-4'-biphenylyl-)amine (IIa); 4-biphenylyl bis(4-acetoxymethyl-4'-biphenylyl)amine (IIb), 3-biphenylyl bis(4-methyl-4'-biphenylyl)amine (IIc), 4-ethoxycarbonyl-4'-biphenyl bis(4-methyl-4'-biphenylyl)amine (IId), and the like.

There is also disclosed in Belgium Patent 763,540 an electrophotographic member having at least two electrically operative layers, the first layer comprising a photoconductive layer which is capable of photogenerating charge carriers, and injecting the photogenerated holes into an active layer containing a transport organic material which is substantially nonabsorbing in the spectral region of intended use, but which is active and that allows injection of photogenerating holes from the photoconductive layer and allows these holes to be transported through the active layer. The active polymers may be mixed with inactive polymers or nonpolymeric materials. Also, there is disclosed in U.S. Pat. Nos. 4,232,102 and 4,233,383, the disclosures of which are totally incorporated herein by reference, the selection of sodium carbonate doped and barium carbonate doped photoresponsive imaging members containing trigonal selenium.

While imaging members with various charge transporting substances, including aryl amines, are suitable for their intended purposes, there continues to be a need for improved members, particular layered members, which are comprised of new economical charge transporting substances. Further, there continues to be a need for layered imaging members wherein layers are sufficiently adhered to one another to allow the continuous use of such members in repetitive imaging systems. Also, there continues to be a need for charge transporting substances which are compatible with various common resinous binders, such as polycarbonates or polyesters, thereby ensuring the long-term stability of the members. Also, there continues to be a need for charge transporting substances that are also useful as protective overcoating layers, and as interface materials for various imaging members. Furthermore, there is a need for charge transport compounds that are nontoxic, and wherein such members are inert to the users thereof. A further need resides in the provision of novel efficient charge transport compounds which are readily accessible synthetically from inexpensive commercial starting materials.

SUMMARY OF THE INVENTION

It is therefore an object of the present invention to provide layered photoresponsive imaging members with the advantages indicated herein.

It is yet another object of the present invention to provide improved layered photoresponsive imaging members with certain novel charge transport compounds dispersed in an inactive resinsous binder in contact with a photogenerating layer.

In a further object of the present invention there is provided an improved layered photoresponsive imaging member with a photogenerating layer situated between a supporting substrate, and a charge transport layer comprised of the components disclosed herein.

In yet another object of the present invention there is provided an improved photoresponsive imaging member comprised of a charge transporting composition layer situated between a supporting substrate and a photogenerating layer.

In yet another object of the present invention there are provided imaging and printing methods with the layered imaging members disclosed herein.

Another object of the present invention resides in the provision of charge transport compounds which nontoxic, and are safe and inert to the users of the devices within which they are incorporated.

A further object of the present invention is to provide improved layered imaging members which are insensitive to changes in environmental conditions with the charge transport compounds described herein.

In yet a further object of the present invention there are provided novel efficient charge transport compounds which are readily accessible by simple common synthetic processes.

These and other objects of the present invention are accomplished by the provision of layered imaging members comprised, for example, of a photogenerating layer, and a charge transport layer comprised of diaryl biarylylamine compounds or components. More specifically, the present invention is directed to layered imaging members comprised of photogenerating layers, and in contact therewith charge transport layers comprised of the diaryl biarylylamines of Formula (I) as illustrated herein dispersed in resinous binders.

In one specific embodiment, the present invention is directed to an improved layered photoconductive imaging member comprised of a supporting substrate, a photogenerating layer comprised of inorganic photoconductive pigments optionally dispersed in an inactive resinous binder, and in contact therewith a charge transport layer comprised of diaryl biarylylamines of the following Formula (I) dispersed in resinous binders.

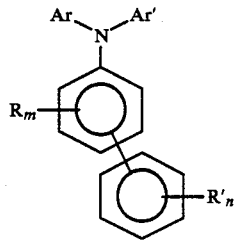

(I)

where Ar and Ar′ are independently selected from the group consisting of phenyl, naphthyl, substituted phenyl, substituted naphthyl, and the like such as alkylphenyl, halophenyl, alkoxyphenyl, dialkylphenyl, dialkoxyphenyl, dihalophenyl, alkyl-alkoxyphenyl, alkylhalophenyl, alkoxyhalophenyl, alkylnaphthyl, and the like; R and R′ are electron donating or weakly electron donating substituents such as halogen, including chloride or bromine, alkyl, alkoxy, hydrogen, and mixtures thereof providing the objectives of the present invention are achieved, and the like; and and m and n are numbers preferably 0, 1 or 2. Alkyl and alkoxy substituents include those containing from 1 to about 25 carbon atoms such as methyl, methoxy, ethyl, ethoxy, propyl, propoxy, butyl, butoxy, pentyl, pentoxy, hexyl, hexoxy, heptyl, octyl, octoxy, nonyl, nonoxy, decyl, decoxy, and the like. Halogen includes chloride, bromide, iodide, and fluoride.

Examples of specific charge transporting compounds include, but are not limited to, diaryl biarylylamines; bis(p-tolyl)-4-biphenylylamine (IIa); bis(p-chlorophenyl)-4-biphenylylamine (IIb); N-phenyl-N-(4-biphenylyl)-p-toluidine (IIc); N-(4-biphenylyl)-N-(p-chlorophenyl)-p-toluidine (IId); N-phenyl-N-(4-biphenylyl)-p-anisidine (IIe); bis(m-anisyl)-4-biphenylylamine (IIIa); bis(m-tolyl)-4-biphenylylamine (IIIb); bis(m-chlorophenyl)-4-biphenylylamine (IIIc); N-phenyl-N-(4-biphenylyl)-m-toluidine (IIId); N-phenyl-N-(4-bromo-4′-biphenylyl)-m-toluidine (Iva); diphenyl-4-methyl-4′-biphenylylamine (IVb); N-phenyl-N-(4-ethoxycarbonyl-4′-biphenylyl)-m-toluidine (IVc); N-phenyl-N-(4-methoxy-4′-biphenylyl)-m-toluidine (IVd); N-(m-anisyl)-N-(4-biphenylyl)-p-toluidine (IVe); bis(m-tolyl)-3-biphenylylamine (Va); N-phenyl-N-(4-methyl-3′-biphenylyl)-p-toluidine (Vb); N-phenyl-N-(4-methyl-3′-biphenylyl)-m-anisidine (Vc); bis(m-anisyl)-3-biphenylylamine (Vd); bis(p-tolyl)-4-methyl-3′-biphenylylamine (Ve); N-p-tolyl-N-(4-methoxy-3′-biphenylyl)-m-chlororaniline (Vf), and the like, reference for example the following formulas:

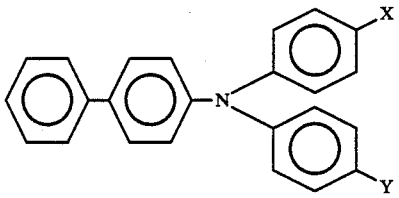

(II)

(a) X = Y = $CH_3$
(b) X = Y = Cl
(c) X = H; Y = $CH_3$
(d) X = Cl; Y = $CH_3$
(e) X = H; Y = $OCH_3$

-continued

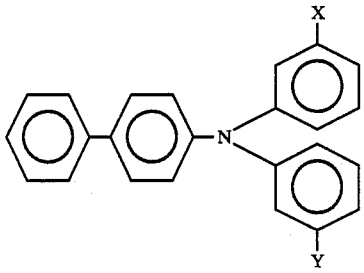

(III)

(a) X = Y = $OCH_3$
(b) X = Y = $CH_3$
(c) X = Y = Cl
(d) X = $CH_3$; Y = H

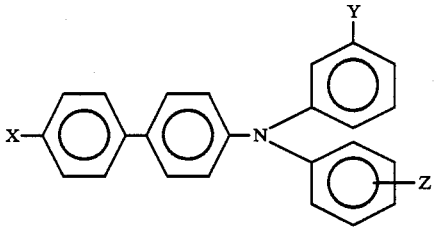

(IV)

(a) X = Br; Y = $CH_3$; Z = H
(b) X = $CH_3$; Y = Z = H
(c) X = COOEt; Y = $CH_3$; Z = H
(d) X = $OCH_3$; Y = $CH_3$; Z = H
(e) X = H; Y = $OCH_3$; Z = p-$CH_3$

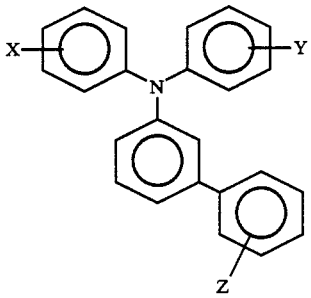

(V)

(a) X = Y = m-$CH_3$; Z = H
(b) X = H; Y = p-$CH_3$; Z = 4*-$CH_3$
(c) X = H; Y = m-$OCH_3$; Z = 4-$CH_3$
(d) X = Y = m-$OCH_3$; Z = H
(e) X = Y = Z = 4-$CH_3$
(f) X = m-Cl; Y = p-$CH_3$; Z = 4-$OCH_3$

*Represents the position on the ring.

Examples of preferred charge transporting compounds include those wherein X, Y, and Z are selected from the groups consisting of hydrogen, alkyl, such as methyl, halogen such as a chlorine atom, and alkoxy such as methoxy.

Examples of alkyl and alkoxy groups as indicated herein include those with from 1 carbon atom to about 25 carbon atoms, and preferably from about 1 carbon atom to about 8 carbon atoms, inclusive of methyl, methoxy, ethyl, ethoxy, propyl, propoxy, butyl, butoxy, pentyl, pentoxy, hexyl, heptyl, octyl, octoxy, nonyl, nonoxy, decyl, decoxy, pentadecyl, stearyl, and other similar substituents. Specific preferred alkyl and alkoxy groups are methyl, methoxy, ethyl, ethoxy, propyl, propoxy, butyl and butoxy. Halogen atoms include iodine, bromine, chlorine, and fluroine.

The photoresponsive imaging members of the present invention can be prepared by a number of known methods, the process parameters and the order of the coating of the layers being dependent on the member desired.

Thus, for example, the photoresponsive members of the present invention can be prepared by providing a conductive substrate with an optional blocking layer and an optional adhesive layer, and applying thereto a photogenerating layer, and overcoating thereon a charge transport layer of the diaryl biarylylamines, or diaryl biarylylamine compounds illustrated herein, dispersed in an optional resinous binder. The improved photoresponsive imaging members of the present invention can be fabricated by common known coating techniques such as by dip coating, draw-down coating, or by spray coating process, depending largely on the type of imaging devices desired. Each coating, however, can be usually dried, for example, in a convection or forced air oven at a suitable temperature before a subsequent layer is applied thereto.

BRIEF DESCRIPTION OF THE DRAWINGS

For a better understanding of the present invention and further features thereof, reference is made to the following detailed description of various preferred embodiments wherein.

DETAILED DESCRIPTION OF THE INVENTION

Figure 1:
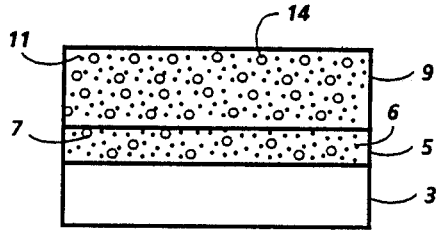
FIG. 1 represents a partially schematic cross-sectional view of a photoresponsive imaging member of the present invention.

Illustrated in FIG. 1 is a photoresponsive imaging member of the present invention comprising a supporting substrate 3, a charge carrier photogenerating layer 5 comprised of a photogenerating pigment 6 optionally dispersed in inactive resinous binder composition 7, and a hole or charge transport layer 9 comprised of the diaryl biarylylamines of the formulas as illustrated herein as a charge transporting substance 11 dispersed in an inactive resinous binder 14. In an alternative embodiment of the present invention, and in further regard to FIG. 1, the charge transporting layer can be situated between the supporting substrate and the photogenerating layer.

Figure 2:
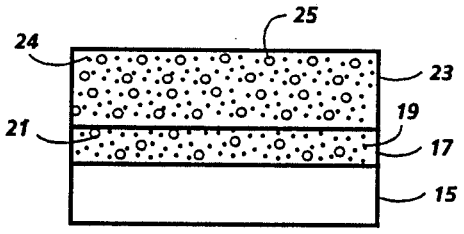
FIGS. 2 and 2A represent a partically schematic cross-sectional view of a photoresponsive imaging member of the present invention.

Illustrated in FIG. 2 is a preferred photoresponsive imaging member of the present invention comprised of a conductive supporting substrate 15 of aluminzed Mylar, a photogenerating layer 17 comprised of trigonal selenium photogenerating pigments 19 optionally dispersed in a poly(vinylcarbazole) resinous binder 21, and a charge transport layer 23 comprised of bis(p-tolyl)-4-biphenylylamine (IIa), phenyl-m-tolyl-4-biphenylylamine (IIId), or bis(m-anisyl)-4-biphenylylamine (IIIa) 24 dispersed in a polycarbonate resinous binder 25.

Figure 2A:
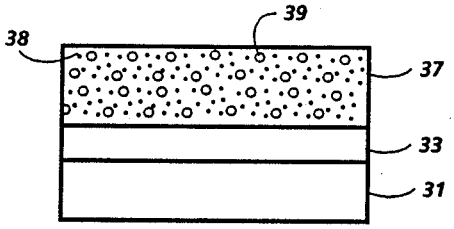

Another preferred photoresponsive imaging member, reference FIG. 2A, is comprised of a conductive supporting substrate 31 of aluminum, a photogenerating layer comprised of amorphous selenium or amorphours selenium alloy 33, especially arsenic and selenium tellurium, and a charge transport layer 37 comprised of bis(p-tolyl)-4-biphenylylamine (IIa), phenyl-m-tolyl-4-biphenylylamine (IIId), or bis(m-anisyl)-4-biphenylylamine (IIIa) 38 dispersed in a Makrolon polycarbonate resinous binder 39.

Figure 3:
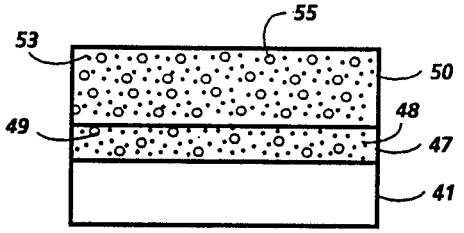
FIG. 3 represents a partially shematic cross-sectional view of a photoresponsive imaging member of the present invention wherein the charge transporting layer is situated between a supporting substrate and the photogenerating layer.

Illustrated in FIG. 3 is another photoresponsive imaging member of the present invention comprised of a conductive supporting substrate 41 of aluminized Mylar, a charge transport layer 47 comprised of bis(p-tolyl)-4-biphenylylamine (IIa), phenyl-m-toly-4-biphenylylamine (IIId), or bis(m-anisyl)-4-biphenylylamine (IIIa) 48 dispersed in a polycarbonate resinous binder 49, and a photogenerating layer 50 comprised of trigonal selenium photogenerating pigments 53 optionally dispersed in a polyester resinous binder 55.

The supporting substrate layers may be opaque or substantially transparent and may comprise any suitable material having the requisite mechanical properties. The substrate may comprise a layer of an organic or inorganic material having a conductive surface layer arranged thereon or a conductive material such as, for example, aluminum, chromium, nickel, indium, tin oxide, brass, or the like. The substrate may be flexible or rigid and many have any of many different configurations such as, for example, a plate, a cylindrical drum, a scroll, and the like. The thickness of the substrate layer is dependent on many factors including, for example, the components of the other layers, and the like. Generally, however, the substrate is of a thickness of from about 50 microns to about 5,000 microns.

Examples of preferred photogenerating layers, especially since they permit imaging members with a photosensitivity of from about 400 to about 700 nanometers, for example, include those comprised of known photoconductive charge carrier generating materials, such as amorphous selenium alloys, halogen doped amorphous selenium, halogen doped amorphous selenium alloys, trigonal selenium, mixtures of Groups IA and IIA elements, selenite and carbonates with triginal selenium, reference U.S. Pat. Nos. 4,232,102 and 4,233,283, the disclosures of each of these patents being totally incorporated herein by reference, copper and chlorine doped cadmium sulfide, cadmimum selenide and cadmium sulfur selenide, and the like. Examples of specific alloys include selenium arsenic with from about 95 to about 99.8 weight percent selenium; selenium tellurium with from about 70 to about 90 weight percent of selenium; the aforementioned alloys containing halogens such as chlorine in amounts of from about 100 to about 1,000 parts per million; ternary alloys; and the like. The thickness of this photogenerating layer is dependent on a number of actors, such as the materials included in the other layers, and the like. Generally, however, this layer is of a thickness of from about 0.1 micron to about 5 microns, and preferably from about 0.2 mcirons to about 2 microns depending on the photoconductive volume loading, which may vary from 5 percent to 100 percent by weight. Generally, it is desirable to provide this layer in a thickness which is sufficient to absorb about 90 percent or more of the incident radiation which is directed upon it in the imagewise exposure step. The maximum thickness of this layer is dependent primarily upon factors such as mechanical considerations, for example, whether a flexible photoresponsive device is desired. Optional resin binders for the photogenerating compositions are, for example, the polymers as illustrated in U.S. Pat. No. 3,121,006, the disclosure of which is totally incorporated herein by reference, polyesters, poly(vinylbutyrals), polycarbonate resins, epoxy resins, poly(hydroxyether) resins, and the like. Also, there may be selected as photogenerators, provided the objectives of the present invention are achieved, certain organic components such as squarines, perylenes, reference for example U.S. Pat. No. 4,587,189, the disclosure of which is totally incorporated herein by reference, metal phthalocyanines, metal free phthalocyanines, vanadyl phthalocyanine, dibromoanthrone, and the like, as it is believed that the resulting imaging members are of higher sensitivity, and possess more desirable dark decay properties than similar imaging members wherein the photogenerator is a triazo pigment.

The transport layer usually includes a highly insulating and transparent resinous material or inactive binder resinous material such as those described in U.S. Pat. No. 3,121,006, the disclosure of which is totally incorporated herein by reference. For the transport layer, a dispersion of from, for example, about 10 percent to 75 percent by weight of the charge transport compounds, or compound illustrated herein in a resinous binder such as polycarbonate, especially Makrolon, polyester, epoxy resins or the like is employed. The thickness of this layer is, for example, from about 5 microns to about 50 microns with the thickness depending predominantly on the nature of intended applications. In addition, a layer of adhesive material to promote the adhesion of the transport layer to the photogenerating layer can be utilized. This layer may comprise common known adhesive materials such as polyester resins, reference 49,000 polyester available from Goodyear Chemical Company, polysiloxane, acrylic polymers, and the like. A thickness of from about 0.001 micron to about 0.1 micron for this layer is generally employed. Hole blocking layers such as those derived from polycondensation of aminopropyl trialkoxysilane or aminobutyl trialkoxysilane may optionally be introduced between the substrate and the photogenerating layer to improve the dark decay characteristics of the imaging member. Typically, this layer has a thickness of from about 0.001 micron to about 5 microns or more in thickness depending on the effectiveness with which this layer prevents the dark injection of charge carriers into the photogenerating layer.

The hole or charge transporting diaryl biarylylamine derivatives of the present invention can be readily synthesized from commerically avaiable reaction materials. There are many viable synthetic processes by which these compounds can be obtained, including the one-step Ullman condensation of an arylamine with an iodoarene. Thus, one process embodiment involves the condensation of a biarylylamine with 2 equivalents of iodoarene, and another involves the condensation of a diarylamine with an iodobiaryl to afford the same product. The aforementioned Ullman condensation is generally carried out in a suitable high boiling solvent such as the high-boiling hydrocarbons, for example, Soltrol 220, Soltrol 170, and the like, dimethylsulfoxide, dimethylformamide, dimethylacetamide, and the like, at temperatures ranging from ambient temperature to about 300° C., and preferably from 150° C. to 250° C. The condensation is also executed in the presence of a suitable catalyst and a base, such as an alkali hydroxide. Preferred catalysts are copper powder, copper bronze powder, cuprous oxide, cuprous halides, cuprous triflate, and other cuprous salts. The catalyst is employed in the amount of 0.1 to about 1.0 equivalent of iodoarene used with the preferred catalyst stoichiometry being in the order of about 0.5 equivalent of the iodoarene present. Preferred bases are potassium hydroxide, potassium carbonate and some aromatic amine bases such as, for example, pyridine and quinoline. The base is generally employed in about 10 percent to 100 percent excess to the iodoarene reactant, preferred stoichiometry being about 20 percent to 40 percent excess. The hole transport compounds are typically isolated by column chromatography, and further purified by recrystallization. The diaryl biarylylamine hole transport products of the present invention that result are characterized by spectroscopic means and by elemental analysis.

The diaryl biarylylamine hole transport compounds of the present invention possess very efficient hole transport properties and extremely low dark decay characteristics, and are equal or superior to those exhibited by known aryl amine hole transport compounds. Also, these charge transport compounds are compatible with many common matrix binders ensuring their long-term stability in the transport layer. As the transport layer of the present invention is transparent to the visible light, all the visible radiations used in the exposure reach the photogenerating layer without noticeable loss. The imaging members of the present invention possess high photosensitivity with a half-decay exposure sensitivity being in the range of 1.0 to about 3.0 ergs/cm$^2$, and are thus exceptionally photosensitive imaging devices or members.

The following examples are being supplied to further define specific embodiments of the present invention, it being noted that these examples are intended to illustrate and not limit the scope of the present invention. Parts and percentages are by weight unless otherwise indicated.

EXAMPLE I

Bis(p-tolyl)-4-Biphenylylamine(IIa)

A mixture of 65.4 grams of p-iodotoluene, 11.3 grams of copper bronze powder and 55.3 grams of potassium carbonate in 150 milliliters of Soltrol 220 was mechanically stirred in a 250 milliliter round-bottomed flask fitted with a reflux condenser. The mixture was first heated to 160° C. with a heating mantle before 16.92 grams of 4-aminobiphenyl was added. After the addition, the reaction mixture was heated under reflux at 220° C. for five hours. After cooling, the reaction mixture was filtered, and the resulting filter cake was washed with 50 milliliters of heptane. The filtrate was distilled under reduced pressure to remove Soltrol 220. The resulting solid residue was purified by column chromatography on silica gel to afford a white solid. Further purification by recrystallization from isopropanol yielded 16.2 grams of analytically pure bis(p-tolyl)-4-biphenylylamine, melting point, 94° to 95° C.

| | |
|---|---|
| $^1$H-NMR($CDCl_3$), δ (ppm): | 2.35(s,6H); 7.0 to 7.6(m,17H) |
| Elemental Analysis, Cald. for $C_{26}H_{23}N$: | C,89.36; H,6.63; N,4.01 |
| Found: | C,89.55; H,659; N,4.09 |

EXAMPLE II

Bis(m-anisyl)-4-Biphenylylamine(IIIa)

A mixture of 70.0 grams of m-iodotoluene, 7.0 grams of copper bronze powder and 55 grams of potassium carbonate in 200 milliliters of Soltrol 220 was mechanically stirred and heated in a 300 milliliter round-bottomed flask fitted with a reflux condenser. When the temperature of the mixture reached 160° C., 16.9 grams of 4-aminobiphenyl was added, and the resulting reaction mixture was heated under reflux at 220° C. for two hours. At this stage, another mixture of 8.0 grams of potassium carbonate and 4.0 grams of copper bronze powder was added, and heating was continued at this temperature for another three hours. The hot reaction mixture was filtered, and the filtrate was cooled to room temperature yielding an offwhite precipitate. Recrystallization twice from isopropanol afforded 19.5 grams of analytically pure bis(m-anisyl)-4-biphenylylamine, m.p. 98° to 98.5° C.

| | |
|---|---|
| $^1$H-NMR ($CDCl_3$), δ (ppm): | 3.75 (s, 6H); 6.5 to 6.8 (m, 6H); 7.1 to 7.6(m,11H |
| Elemental Analysis, Cald. for $C_{26}H_{23}NO_2$: | C,81.86; H,6.08; N,3.67 |
| Found: | C,81.77; H,6.09; N,3.70 |

EXAMPLE III

Bis(m-chlorophenyl)-4-Biphenylylamine(IIIC)

A mixture of 5.3 grams of 4-aminobiphenyl, 25.0 grams of m-chloroiodobenzene and 16.5 grams of potassium carbonate in 150 milliliters of dimethyl sulfoxide was mechanically stirred and heated to 110° C. in a round-bottomed flask fitted with a reflux condenser under a nitrogen atmosphere. Subsequently, 9.5 grams of copper bronze powder was added, and the temperature of the reaction mixture was raised to 170° C. After 48 hours, the reaction mixture was filtered while still hot, and the filtrate was evaporated under reduced pressure to provide a viscous oil. Purification by column chromatography on neutral alumina using a mixture of methylene chloride and hexane (1:10) as the eluent afforded 7.9 grams of analytically pure bis(m-chlorophenyl)-4-biphenylylamine.

| | |
|---|---|
| $^1$H-NMR($CDCl_3$), δ (ppm): | 7.12(AA'BB',8H); 7.28(AA'BB', 4H); 7.25 to 7.60 (AA'BB'C,5H) |
| Elemental Analysis, Cald. for $C_{24}H_{17}Cl_2N$: | C,73.85; H,4.39; N,3.59 |
| Found: | C,73.66; H,4.41; N,3.38 |

EXAMPLE IV

A layered photoresponsive imaging member with a hole transport layer comprised of a dispersion of the bis(p-tolyl)-4-biphenylylamine of Example I in a polycarbonate binder, and photogenerating layer comprised of trigonal selenium, was prepared as follows:

A dispersion of trigonal selenium and poly(N-vinylcarbazole) was prepared by ball milling 1.6 grams of trigonal selenium and 1.6 grams of poly(N-vinylcarbazole) in 14 milliliters each of tetrahydrofuran and toluene. Thereafter, 10 grams of the resulting slurry was then diluted with a solution of 0.25 gram of bis(p-tolyl)-4-biphenylylamine in 5 milliliters each of tetrahydrofuran and toluene. A 1.0 micron thick photogenerator layer was fabricated by coating the above dispersion onto an aluminized Mylar substrate, thickness of 2 mils or 50 microns, with a multiple-clearance film applicator, followed by drying in a forced air oven at 135° C. for 5 minutes. A solution for the hole transport layer was then prepared by dissolving 1.0 gram of the above prepared bis(p-tolyl)-4-biphenylylamine and 1.0 gram of Makrolon polycarbonate in 12 milliliters of methylene chloride. This solution was then coated over the photogenerator layer by means of a multiple-clearance film applicator. The resulting member was subsequently dried in a forced air oven at 130° C. for 30 minutes resulting in a 30 microns thick transport layer.

The fabricated imaging member was electrically tested by negatively charging it with a corona, and discharged by exposing to white light wavelengths of from 400 to 700 nanometers. Charging was accomplished with a single wire corotron in which the wire was contained in a grounded aluminum channel and was strung between two insulating blocks. The acceptance potential of this imaging member after charging, and its residual potential after exposure were recorded. The procedure was repeated for different exposure energies supplied by a 75 watt Xenon arc lamp of incident radiation, and the exposure energy required to discharge the surface potential of the member to half of its original value was determined. This surface potential was measured using a wire loop probe contained in a shielded cylinder, and placed directly above the photoreceptor member surface. This loop was capacitively coupled to the photoreceptor surface so that the voltage of the wire loop corresponds to the surface potential. Also, the cylinder enclosing the wire loop was connected to the ground.

For the above prepared imaging member the acceptance potential was 1,000 volts, the residual potential was 40 volts, and the half decay exposure sensitivity was 2.0 ergs/cm$^2$. Further, the electrical properties of the above prepared photoresponsive imaging member remained essentially unchanged for 1,000 cycles of repeated charging and discharging.

EXAMPLE V

A layered photoresponsive imaging member with a hole transport layer of bis(m-anisyl)-4-biphenylylamine of Example II in polycarbonate Z, and an amorphous selenium photogenerator layer was fabricated as follows:

A 0.5 micron thick layer of amorphous selenium on a ball grained aluminum plate of a thickness of 7 mils (175 microns) was prepared by conventional vacuum deposition techniques. Vacuum deposition was accomplished at a vacuum of $10^{-6}$ Torr, while the substrate was maintained at about 50° C. A hole transport layer in contact with and on top of the amorphous selenium layer was obtained by coating a solution of 50 percent by weight each of bis(m-anisyl)-4-biphenylylamine and 50 weight percent of polycarbonate Z in methylene chloride using a multiple-clearance film applicator. This solution was prepared by dissolving 1.2 grams of bis(m-anisyl)-4-biphenylylamine and 1.2 grams of polycarbonate Z in 12 milliliters of methylene chloride. Thereafter, the resulting imaging member or device was dried in a forced air oven at 50° C. for 1 hour to form a 35 microns thick transport layer. Subsequently, the imaging member was cooled to room temperature, followed by electrical testing by repeating the procedure of Example IV with the exception that a 450 nanometers monochromatic light was selected for irradiation. Specifically, this imaging member was negatively charged to 1,000 volts and discharged to a residual potential of 50 volts. The half decay exposure sensitivity for the above prepared imaging member was 2.5 ergs/cm$^2$. The electrical performance of this imaging member remained essentially the same after 1,000 cycles of repeated charging and discharging.

EXAMPLE VI

A layered photoresponsive imaging member with a charge, or hole transport layer of bis(p-tolyl)-4-biphenylylamine of Example I in polycarbonate Z, and an amorphous selenium photogenerator layer was fabricated as follows:

A 0.5 micron thick layer of amorphous selenium on a ball grained aluminum plate of a thickness of 7 mils (175 microns) was prepared by conventional vacuum deposition techniques in accordance with the procedure of Example V. A hole transport layer in contact with and on top of the amorphous selenium layer was obtained by coating a solution of 50 percent by weight each of bis(p-tolyl)-4-biphenylylamine and polycarbonate Z in methylene chloride using a multiple-clearance film applicator. This solution was prepared by dissolving 1.2 grams of bis(m-anisyl) biphenylylamine and 1.2 grams of polycarbonate Z in 12 milliliters of methylene chloride. Thereafter, the resulting device was dried in a forced air oven at 50° C. for 1 hour to form a 22 microns thick transport layer. Subsequently, the imaging member was cooled to room temperature, followed by electrical testing by repeating the procedure of Example IV with the exception that a 450 nanometers monochromatic light was selected for irradiation. Specifically, the above prepared imaging member was negatively charged to 800 volts and discharged to a residual potential of 20 volts. The half decay exposure sensitivity for this member was 2.5 ergs/cm$^2$. The electrical performance of this imaging member remained essentially the same after 1,000 cycles of repeated charging and discharging.

EXAMPLE VII

A layered photoresponsive imaging member with a hole transport layer of bis(m-anisyl)-4-biphenylylamine of Example II in poly(methyl methacrylate), and an amorphous selenium photogenerator layer was fabricated as follows:

A 0.5 micron thick layer of amorphous selenium on a ball grained aluminum plate of a thickness of 7 mils was prepared in accordance with the procedure of Example V. A hole transport layer in contact with and on top of the amorphous selenium layer was obtained by coating a solution of 50 percent by weight each of bis(m-anisyl)-4-biphenylylamine and poly(methyl methacrylate) in methylene chloride using a multiple-clearance film applicator. This solution was prepared by dissolving 0.7 gram of the above prepared bis(m-anisyl)-4-biphenylylamine and 0.7 gram of poly(methyl methacrylate) in 8 milliliters of methylene chloride. Thereafter, the resulting device or imaging member was dried in a forced air oven at 40° C. for 1 hour to form a 30 microns thick transport layer. Subsequently, the imaging member was cooled to room temperature, followed by electrical testing by repeating the procedure of Example IV with the exception that a 450 nanometers monochromatic light was selected for irradiation. Specifically, this imaging member was negatively charged to 1,000 volts and discharged to a residual potential of 70 volts. The half decay exposure sensitivity for this member was 2.7 ergs/cm$^2$. The electrical performance of this imaging member remained essentially the same after 1,000 cycles of repeated charging and discharging.

EXAMPLE VIII

A photoresponsive device comprised of bis(m-anisyl)-4-biphenylylamine of Example II as the transporting moleculars, and squarylium pigments as the photogenerator was prepared as follows:

A ball grained aluminum substrate was coated with a solution of 1 milliliter of 3-aminopropyltrimethoxysilane in 100 milliliters of ethanol. The coating was heated at 110° C. for 10 minutes resulting in the formation of a 0.1 micron thick polysilane layer. A dispersion of a photogenerator prepared by ball milling a mixture of 0.075 gram of bis(N,N'-dimethylaminophenyl)-squaraine and 0.13 gram of Vitel PE-200 polyester (Goodyear) in 12 milliliters of methylene chloride for 24 hours was then coated on top of the polysilane layer. After drying the coating in a forced air oven at 135° C. for 6 minutes, a 0.5 micron thick squarylium photogenerating layer was obtained.

A solution for the transport layer was then prepared by dissolving 1.0 gram each of bis(m-anisyl)-4-biphenylylamine and Makrolon polycarbonate in 15 milliliters of methylene chloride. This solution was then coated over the above photogenerator layer using a Bird Film applicator. The resulting device was dried in a forced air oven at 135° C. for 30 minutes resulting in a 20 micron thick electron transport layer.

Electrical testing was affected by repeating the procedure of Example IV. Specifically, the above prepared imaging member was charged negatively to 1,000 volts and discharged with 830 nanometers monochromatic light. For this imaging device, the half decay exposure sensitivity was 3.0 ergs/cm$^2$.

EXAMPLE IX

A layered photoresponsive imaging member containing bis(m-anisyl)-4-biphenylylamine of Example II in Merlon polycarbonate binder as the transport layer, and trigonal selenium as the photogenerator was prepared as follows:

A dispersion of trigonal selenium and poly(N-vinylcarbazole) was prepared by ball milling 1.6 grams of trigonal selenium and 1.6 grams of poly(N-vinylcarbazole) in 14 milliliters each of tetrahydrofuran and toluene. Thereafter, 10 grams of the resulting slurry was diluted with a solution of 0.25 gram of bis(m-tolyl)-4-biphenylylamine in 5 milliliters each of tetrahydrofuran and toluene. A 1.0 micron thick photogenerator layer was fabricated by coating the above dispersion onto an aluminized Mylar substrate with a thickness of 2 mils with a multiple-clearance film applicator, followed by drying in a forced air oven at 135° C. for 5 minutes. A solution for the hole transport layer was then prepared by dissolving 1.0 gram of bis(m-anisyl)-4-biphenylylamine and 1.0 grams of Merlon polycarbonate in 12 milliliters of methylene chloride. This solution was then coated over the photogenerator layer by means of a multiple-clearance film applicator. The resulting member was dried in a forced air oven at 130° C. for 30 minutes resulting in a 25 microns thick transport layer.

Electrical testing for the above prepared imaging member was then accomplished by repeating the procedure of Example IV. Specifically, this imaging member was negatively charged to 1,100 volts and exposed to white light of wavelengths of 400 to 700 nanometers. The half decay exposure sensitivity of this device was 2.5 ergs/cm$^2$, and its electrical properties remained subtantially the same after 1,000 cycles of repeated charging and discharging.

Although the invention has been described with reference to specific preferred embodiments, it is not intended to be limited thereto, rather those skilled in the art will recognize variations and modifications may be made therein which are within the spirit of the invention and within the scope of the following claims.

What is claimed is:

1. A photoconductive imaging member comprised of an inorganic photogenerating layer, or a photogenerating layer selected from the group consisting of squaraines, perylenes, metal phthalocyanines, metal free phthalocyanines, vanadyl phthalocyanines, or dibromoanthanthrone; and a charge transport layer comprised of diaryl biarylylamine compounds of Formula (I) wherein Ar is naphthyl; Ar' is selected from the group consisting of phenyl, naphthyl, substituted phenyl, and substituted naphthyl; R and R' are electron donating substituents; and m and n represent the numbers 0, 1, or 2.

2. A photoconductive imaging member comprised of an inorganic photogenerating layer, or a photogenerating layer selected from the group consisting of squaraines, perylenes, metal phthalocyanines, metal free phthalocyanines, vanadyl phthalocyanines, or dibromoanthanthrone; and a charge transport layer comprised of diaryl biarylylamine compounds of Formula (I) wherein Ar' is naphthyl; Ar is selected from the group consisting of phenyl, naphthyl, substituted phenyl, and substituted naphthyl; R and R' are electron donating substitutents; and m and n represent the numbers 0, 1, or 2.

* * * * *